US006959699B2

(12) United States Patent
Shinogle et al.

(10) Patent No.: US 6,959,699 B2
(45) Date of Patent: Nov. 1, 2005

(54) INJECTION OF FUEL VAPOR AND AIR MIXTURE INTO AN ENGINE CYLINDER

(75) Inventors: Ronald D. Shinogle, Peoria, IL (US); Berfan K. Kochgiri, W. Peoria, IL (US); Mark S. Cavanagh, Bloomington, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/700,182

(22) Filed: Nov. 3, 2003

(65) Prior Publication Data

US 2005/0092306 A1 May 5, 2005

(51) Int. Cl.[7] ..... F02M 23/00
(52) U.S. Cl. ..... 123/531; 123/532; 239/533.1
(58) Field of Search ..... 123/531, 532; 239/533.1, 533.2, 407

(56) References Cited

U.S. PATENT DOCUMENTS

| | | | | |
|---|---|---|---|---|
| 3,782,639 A | | 1/1974 | Boltz et al. | |
| 4,899,714 A | | 2/1990 | Schechter et al. | |
| 5,207,383 A | | 5/1993 | Hans et al. | |
| 5,218,943 A | * | 6/1993 | Takeda et al. | 123/531 |
| 5,269,281 A | | 12/1993 | Hafner | |
| 5,295,352 A | | 3/1994 | Beebe et al. | |
| 5,875,743 A | | 3/1999 | Dickey | |
| 5,899,389 A | * | 5/1999 | Pataki et al. | 239/533.2 |
| 5,915,365 A | | 6/1999 | Meisinger et al. | |
| 6,026,769 A | | 2/2000 | Anbarasu et al. | |
| 6,189,495 B1 | | 2/2001 | Tuckey et al. | |
| 6,290,215 B1 | | 9/2001 | Pinsker | |
| 6,769,635 B2 | * | 8/2004 | Stewart et al. | 239/558 |
| 6,840,458 B2 | * | 1/2005 | Kuzuyama | 239/88 |
| 2003/0173424 A1 | * | 9/2003 | Dentes et al. | 239/533.2 |
| 2004/0055562 A1 | * | 3/2004 | Stewart et al. | 123/299 |
| 2004/0108394 A1 | * | 6/2004 | Lawrence et al. | 239/533.2 |
| 2004/0195385 A1 | * | 10/2004 | Lawrence et al. | 239/533.2 |

* cited by examiner

*Primary Examiner*—John T. Kwon
(74) *Attorney, Agent, or Firm*—Liell & McNeil

(57) ABSTRACT

One strategy for reducing undesirable emissions from internal combustion engines relates to finding ways to better mix fuel and air prior to combustion. One such method is commonly referred to as homogenous charge compression ignition (HCCI); however, that strategy is problematic in both controlling ignition timing and avoiding overstressing the engine at higher speeds and loads. The present invention addresses these issues by mixing air and fuel vapor within an injector instead of within the engine cylinder. The air/fuel mixture is then injected into the engine cylinder at some desired timing and over some desired duration. Such a strategy permits for lower emissions due to better mixing of air and fuel, while also permitting control over some aspects of combustion timing and duration not apparently possible with a conventional HCCI strategy. The present invention is generally applicable to all internal combustion engines, but especially applicable to diesel engines.

41 Claims, 3 Drawing Sheets

INJECTION OF FUEL VAPOR AND AIR MIXTURE INTO AN ENGINE CYLINDER

TECHNICAL FIELD

The present invention relates generally to the operation of internal combustion engines, and more particularly to the injection of a mixture of fuel vapor and air into an engine cylinder.

BACKGROUND

Engineers are constantly seeking ways to reduce undesirable emissions from engines. Over the years, engineers have come to recognize that cleaner burns tend to occur when there is a better mixing of fuel and air prior to combustion. One relatively recent strategy for improving fuel/air mixing is commonly referred to as homogenous charge compression ignition (HCCI). In an HCCI strategy, fuel is injected into the engine cylinder early in the compression stroke. The liquid fuel vaporizes in the engine cylinder and mixes with the air to produce a relatively lean homogenous mixture. As the compression stroke continues, the homogenous charge ignites when pressure and temperature in the cylinder reach the auto-ignition point. Although an HCCI strategy can produce a relatively clean burn with dramatic reductions in undesirable emissions, it remains problematic both in the ability to control ignition timing and operate a given engine in a HCCI mode at high load conditions.

One method attempting to control ignition timing in a homogenous charge compression ignition engine is taught in U.S. Pat. No. 5,875,743 to Dickey. Dickey appears to assert that ignition timing can be controlled by injecting a controlled amount of water into the air brought into the cylinder through the intake valve. Although the usage of water may be a viable strategy in controlling ignition timing in an HCCI engine, there remains the problem of HCCIs' general incompatibility with higher engine loads.

At higher engine loads, when the amount of fuel injected is substantially higher than that at lower loads, the very efficient HCCI burn also becomes a liability. Apparently, when a HCCI charge burns, there is little or no flame front, and the entire charge combusts almost simultaneously over a relatively brief duration. With the burn duration being relatively short, the pressure spike produced by the burn can be destructively too high at higher engine loads. Thus, in order to make HCCI viable, ignition timing needs better control, and the combustion duration must be sufficiently long as to not overstress the engine, especially at higher loads.

The present invention is directed to one or more of the problems set forth above.

SUMMARY OF THE INVENTION

In one aspect, a method of operating an engine includes a step of mixing fuel vapor with air in an injector. The mixture of fuel vapor and air are then injected into an engine cylinder. The mixture is ignited in the engine cylinder.

In another aspect, a fuel injector includes an injector body with an air/fuel mixing chamber and a liquid fuel chamber disposed therein. A first valve is at least partially positioned in the injector body and fluidly positioned between the liquid fuel chamber and the air/fuel mixing chamber. A second valve is at least partially positioned in the injector body and fluidly positioned between the air/fuel mixing chamber and an outside surface of the injector body.

In still another aspect, a fuel injection system includes a source of liquid fuel and a nozzle body that includes an air/fuel mixing chamber at least partially disposed therein. A first valve is fluidly positioned between the air/fuel mixing chamber and an outside surface of the nozzle body. A second valve is moveable between a first position in which the air/fuel mixing chamber is fluidly connected to the source of liquid fuel, and a second position in which the air/fuel mixing chamber is closed to the source of liquid fuel.

In still another aspect, an engine includes an engine housing with at least one cylinder. A fuel injector is attached to the engine housing and includes a nozzle tip position in the cylinder. The fuel injector includes an air/fuel mixing chamber at least partially disposed therein, and a valve fluidly positioned between the air/fuel mixing chamber and an outside surface of the nozzle tip.

DETAILED DESCRIPTION

Figure 1:
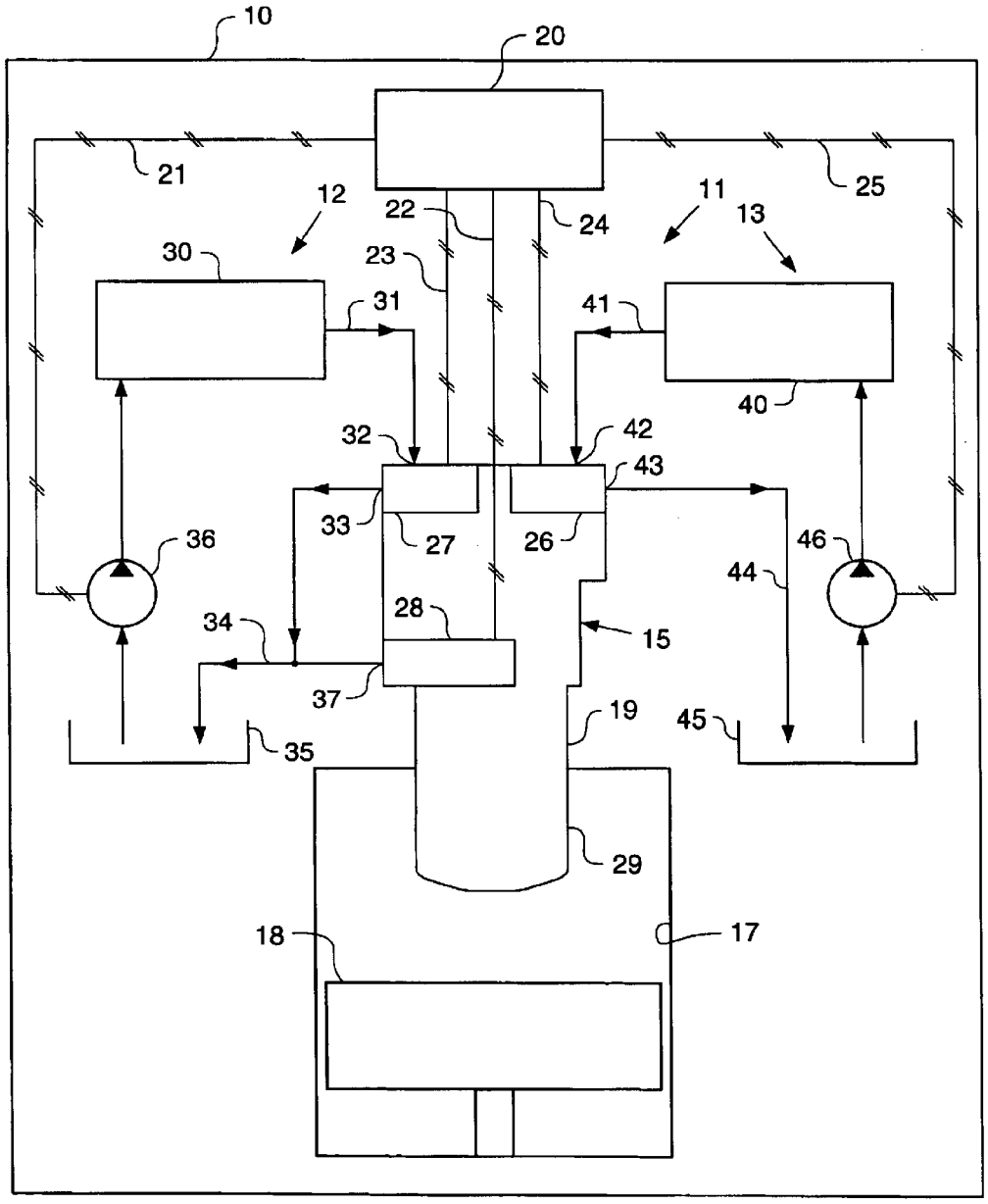
FIG. 1 is an isometric view of an engine according to the present invention.

Referring to FIG. 1, an internal combustion engine 10 includes an engine housing that defines one or more engine cylinders 17, within which a piston 18 reciprocates in a conventional manner. A fuel injection system 11 is attached to engine 10 in a conventional manner to include an individual fuel injector 15 associated with each engine cylinder 17. Each fuel injector 15 preferably includes a nozzle tip 29 located in engine cylinder 17 in a manner typical of that associated with a diesel type engine. Nevertheless, those skilled in the art will appreciate that, although the illustrated example shows a compression ignition engine, the present invention also contemplates other means of igniting a charge in an engine cylinder, including but not limited to spark ignition. Engine 10 generally, and fuel injection system 11 specifically, are controlled in a conventional manner by an electronic control module 20. In the illustrated example, fuel injection system 11 is a dual fluid system that includes a fuel supply system 13 and an actuation fluid system 12. Fuel supply system 13 preferably utilizes conventional distillate diesel fuel as its fuel medium, but could utilize any suitable liquid fuel. Actuation fluid system 12 preferably utilizes engine lubricating oil, but could use any suitable and available fluid for supplying hydraulic fluid pressure to different components within fuel injector 15.

Figure 2:
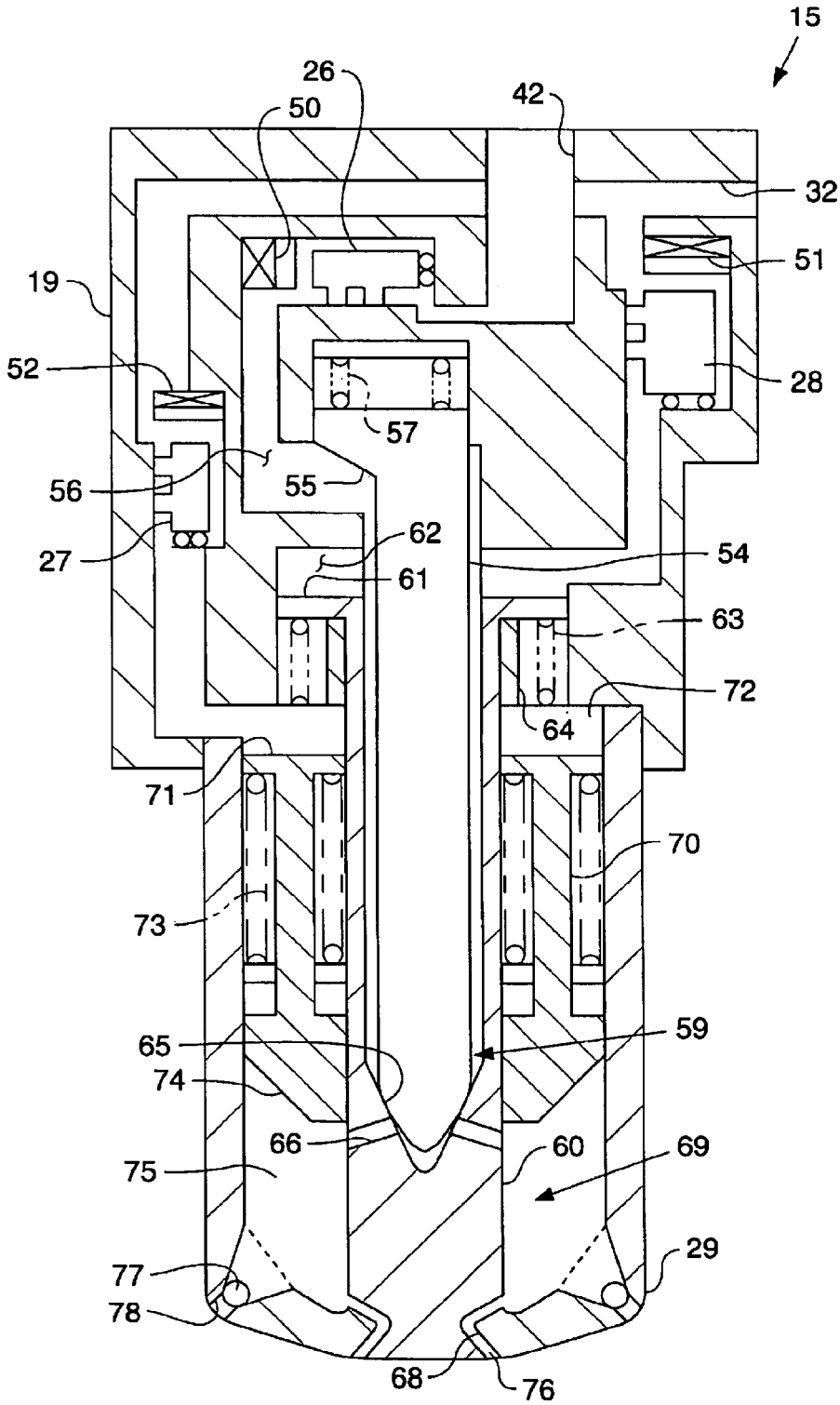
FIG. 2 is a sectioned side diagrammatic view of a fuel injector according to one aspect of the present invention.
Figure 3:
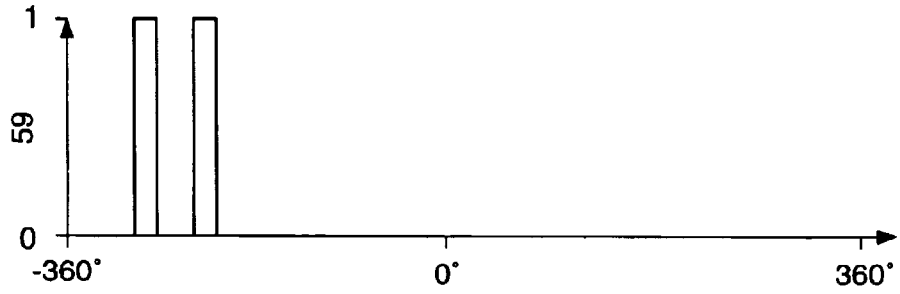
FIG. 3 is a graph of valve 59 (FIG. 2) position verses engine cylinder position for an example injection sequence according to one aspect of the present invention.

Referring in addition to FIG. 2, each fuel injector 15 includes an electronically controlled fuel spray valve 26, an electronically controlled actuation control valve 27 and an electronically controlled nozzle control valve 28 attached to an injector body 19. Nevertheless, those skilled in the art will appreciate that these valves could be located at any suitable location in fuel injection system 11 without necessarily being attached to injector body 19. Electronic control module 20 communicates with, and controls the positioning of, valves 26, 27, and 28 via communication lines 22, 23 and 24, respectively, in a conventional manner. Fuel spray control valve 26 controls the opening and closing of a needle valve 59, which controls the spray of liquid fuel from a liquid fuel chamber 56 to a mixing chamber 75. Actuation control valve 27 controls the application of either high pressure or low pressure actuation fluid onto a hydraulic surface 71 of a piston 70. A portion of mixing chamber 75 is defined by a displacement surface 74 of piston 70. Downward movement of piston 70 injects a fuel/air mixture in mixing chamber 75 into engine cylinder 17 via nozzle outlet 76. Nozzle control valve 28 controls the application of either high pressure or low pressure actuation fluid on an opening hydraulic surface 61 of nozzle valve 69. FIG. 2 shows nozzle valve 69 in its downward open position that fluidly connects mixing chamber 75 to an outside surface of nozzle tip 29 via a frusto conically shaped nozzle outlet 76. Those skilled in the art will appreciate that nozzle outlet 76 and nozzle valve 69 could have any suitable configuration known in the art besides the frusto conical shaped opening 76 shown in FIG. 2.

Fuel supply system 13 includes a high pressure pump 46 that draws low pressure fuel from fuel tank 45 and supplies high pressure fuel to an accumulator 40, which could be a high pressure common fuel rail in the case of a multi-cylinder engine. High pressure fuel is supplied from rail 40 to a fuel inlet 42 via a high pressure fuel supply passage 41. Any fuel leakage and/or spillage is routed back to fuel tank 45 for recirculation via fuel outlet 43 and fuel drain 44. Preferably, high pressure pump 46 is a variable output pump that is controlled by electronic control module 20 in a conventional manner via communication line 25. Thus, in the illustrated embodiment, pressure in common fuel rail 40 is controlled by controlling the output of pump 46. Nevertheless, those skilled in the art will appreciate that fuel pressure supplied to fuel injector 15 could be controlled in any suitable manner. For instance, the present invention is also compatible with a simple pump and line fuel supply system, a common rail, hydraulic pressure intensified systems, cam actuated fuel pressurization or any other suitable manner of pressurizing fuel. In other words, the present invention is compatible with fuel that is pressurized inside and/or upstream from fuel injector 15. However, those skilled in the art will appreciate that because the injection of liquid fuel within injector 15 can occur at substantially lower pressures than those typically encountered in a conventional diesel fuel injector, fuel could be pressurized in fuel injection system 11 at levels substantially lower than that normally encountered in direct injection diesel type fuel injection systems.

Actuation fluid system 12 includes a high pressure pump 36 that draws low pressure lubricating oil from low pressure reservoir 35 (oil pan) and supplies high pressure actuation fluid to an accumulator 30, which is preferably a common actuation fluid rail in the case of a multi cylinder engine. High pressure actuation fluid is supplied to an actuation fluid inlet 32 of fuel injector 15 via a high pressure actuation fluid supply passage 31. Used or leaked actuation fluid is returned to reservoir 35 via actuation fluid outlets 33 and 37 via actuation fluid drain 34 for recirculation. Pressure in common rail 30 is controlled by electronic control module 20 controlling the output of pump 36 in a conventional manner via communication line 21.

Referring in particular to FIG. 2, fuel spray control valve 26 is operable to fluidly connect a liquid fuel chamber 56 to either high pressure fuel inlet 42 or low pressure fuel outlet 43. Valve 26 is preferably biased to a position that connects liquid fuel chamber 56 to low pressure fuel outlet 43, but is moveable to its other position by energizing a first electrical actuator 50. In the illustrated example, electrical actuator 50 is a solenoid, and valve 26 includes a spool valve member attached to the armature of valve 50. Nevertheless, those skilled in the art will appreciate that other types of electrical actuators, such as piezos, could be substituted for the illustrated solenoid. In addition, although valve 26 has been illustrated as including a spool valve member, any suitable valve configuration including a poppet valve member or possibly even a pilot operated valve could be substituted in place of the illustrated valve. Needle valve member 54 is preferably biased toward a down position in contact with needle seat 65 by a biasing spring 57. When in this position, liquid fuel chamber 56 is closed to mixing chamber 75. When fuel pressure in liquid fuel chamber 56 is above a valve opening pressure sufficient to overcome biasing spring 57, such as when valve 26 opens fuel inlet 42, needle valve member 44 lifts away from needle seat 65 to allow liquid fuel to spray into mixing chamber 75 via spray passages 66. Those skilled in the art will appreciate that needle valve 59 could take on other configurations without departing from the present invention. For instance, three way valve 26 could be rearranged to either supply high pressure fuel or low pressure fuel to the spring chamber within which biasing spring 57 is located and within which a closing hydraulic surface of needle valve member 54 is exposed to fluid pressure there. In such an alternative, liquid fuel chamber would always have an unobstructed fluid connection to fuel inlet 42, but the opening and closing of needle valve 59 would be controlled by applying either high or low pressure to the back side or closing hydraulic surface of needle valve member 54. In another variation is the potential for including a simple two way valve between the spring chamber and low pressure fuel outlet 43 while including appropriate flow restrictions that would result in substantial pressure changes when the valve either opens or closes low pressure fuel outlet 43 (FIG. 1). Those skilled in the art will appreciate that any suitable means for controlling the spray of liquid fuel within fuel injector 15 is compatible with the present invention. In still another alternative, either high pressure or low pressure actuation fluid could be supplied to the spring chamber to control the opening and closing of needle valve 59. Thus, the present invention contemplates a direct control needle valve.

Turning now to nozzle control valve 28, it controls the opening and closing of nozzle valve 69, which is fluidly positioned between mixing chamber 75 and the engine cylinder 17. A second electrical actuator 51, which is preferably a solenoid but could be any other suitable actuator such as a piezo, is suitably located in the fuel injection system 11, but is preferably attached to injector body 19. Actuator 51 is operably coupled to nozzle control valve 28, which is preferably a three way spool valve, but could be any other suitable type of valve such as a poppet valve. Preferably, when actuator 51 is deenergized, nozzle control valve 28 is biased to a position that fluidly connects control chamber 62 to low pressure actuation fluid outlet 37 (FIG. 1). When in this position, low pressure is acting on opening hydraulic surface 61 of nozzle valve member 60, resulting in nozzle valve member 60 moving upward under the action of biasing spring 63 to close nozzle outlet 76 and valve seat 68. When actuator 51 is energized, nozzle control valve 28 is moved to a position that fluidly disconnects control chamber 62 from low pressure actuation fluid outlet 37, and fluidly connects the same to high pressure actuation fluid inlet 32. When this occurs, high pressure acting on opening hydraulic surface 61 is preferably sufficient to move nozzle valve member 60 downward away from valve seat 68 to open nozzle outlet 76. Nozzle valve 69 is fully opened when nozzle valve member 60 comes in contact with stop 64, as shown in FIG. 2. The various hydraulic and pneumatic surfaces as well as spring strengths and fluid pressures are preferably such that nozzle valve 69 can be opened by energizing actuator 51 at any desirable timing, including when the engine piston is at or near top dead center and pressure in the engine cylinder is peaking. Nozzle valve 69 is preferably the avenue through which the contents of mixing chamber 75 are injected into the engine cylinder via nozzle outlet 76. In the illustrated embodiment, pressure in mixing chamber 75 and the engine cylinder 17 are maintained at a relative equilibrium via the inclusion of check valves 77 that are located in air inlet passages 78. Thus, during a compression stroke, air from the engine cylinder is forced into mixing chamber 75 past check valves 77. When the contents of mixing chamber 75 are being injected into the engine cylinder, check valve 77 returns to a closed position as shown in FIG. 2. Alternatively, check valves 77 might be eliminated in favor of utilizing nozzle valve 69 as the avenue through which air is fed into mixing chamber 75 and the air/fuel mixture in a chamber is injected into the engine cylinder. In an alternative embodiment in which check valves 77 are eliminated, fluid communication between the engine cylinder 17 and mixing chamber 75 is only available via nozzle outlet 76.

Turning now to actuation control valve 27, its positioning controls whether high or low pressure is applied to hydraulic surface 71 of piston 70. A third electrical actuator 52, which is preferably a solenoid but could be any other suitable electrical actuator such as a piezo, is operably coupled to actuation control valve 27, which is preferably a three way spool valve but could be any other suitable type of valve such as a poppet. Actuation control valve 27 is preferably biased to a position that fluidly connects hydraulic cavity 72 to low pressure actuation fluid outlet 33 (FIG. 1). When in that position, low pressure acts upon hydraulic surface 71, and return spring 73 urges piston 70 upward toward its retracted position. In FIG. 2, piston 70 is shown in motion moving downward a short distance from its upward retracted position. When actuator 52 is energized, hydraulic cavity 72 is connected to high pressure actuation fluid inlet 32 to supply a high pressure force on hydraulic surface 71. The various hydraulic surfaces and spring strength are preferably sized such that when hydraulic surface 71 is exposed to high pressure from actuation fluid inlet 32, piston 70 will be driven downward. Since mixing chamber 75 is partially defined by displacement surface 74, which is a portion of piston 70, the volume of mixing chamber 75 decreases when piston 70 is driven downward. If nozzle valve 69 is in an open position, as shown in FIG. 2, the contents of mixing chamber 75 will be injected into the engine cylinder when piston 70 is driven downward. If nozzle valve 69 is closed, a downward movement of piston 70 will compress the contents of mixing chamber 75. The compressed contents of mixing chamber 75 can then be injected into the engine cylinder at any desired timing by moving nozzle valve 69 to an open position by energizing second electrical actuator 51.

INDUSTRIAL APPLICABILITY

The present invention finds potential application in any internal combustion engine, and is especially applicable to diesel type engines in which fuel is injected directly into the engine cylinder. The present invention also preferably relies upon compression ignition to ignite the charge in the engine cylinder, but is also applicable to engines having an alternative means to ignite a fuel/air charge, such as spark ignition. Although the present invention is illustrated as a two fluid system, the present invention is also applicable to single fluid systems that utilize only fuel. For instance, in an alternative to the illustrated embodiment, pressurized fuel could be used as both the working actuation fluid and the fuel fluid medium with modest plumbing changes known in the art. The illustrated fuel injection system shows two common rails, one for actuation fluid and one for fuel; the fuel and/or actuation fluid could be pressurized in any suitable manner known in the art. In addition, while the illustrated embodiment shows actuation fluid pushing on a piston 70 to inject the air/fuel mixture from mixing chamber 75, piston 70 could be moved in any suitable manner, including but not limited to cam actuation. In addition, the relative affective surface areas of hydraulic surface 71 and displacement surface 74 of piston 70 could be different such that piston 70 could be an intensifier piston, if desired. In such an alternative, the pressure in mixing chamber 75 could be made to be some multiple of the actuation fluid pressure acting on the top of the piston 70. Although the illustrated embodiment shows three separate electrical actuators attached to a fuel injector 15, those skilled in the art will appreciate that electrical control is desirable but not essential to the present invention. In addition, if electrically controlled valves are used, they can be located at any suitable location inside or outside of the injector body without departing from the present invention.

Referring to FIGS. 1 and 2, and in addition to FIGS. 3–6, an example injection sequence according to the present invention will be described. At the beginning of the compression stroke, the engine piston is at bottom dead center, and all three electrical actuators, 50, 51, and 52, are deenergized. Thus, low pressure prevails within fuel injector 15. In the illustrated embodiment, electronic control module 20 controls the pressure of both actuation fluid and fuel in their respective common rails 30 and 40 via control of their respective high pressure pumps 36, and 46. This preferred control allows the fuel pressure injected into mixing chamber 75 to be set independent of engine speed and load. Alternatively, the fuel system could be set at some predetermined pressure with known means and without the closed loop control shown in FIG. 1. In addition, by having the ability to control the actuation fluid pressure, the injection rate of the mixture from mixing chamber 75 can be controlled. In addition, the relative sizing of the surface areas of piston 70 along with the magnitude of the high pressure acting on its top surface can be utilized to control the injection pressure of the mixture from mixing chamber 75 into the engine cylinder. At some desired point or points during the compression stroke, liquid fuel is sprayed into mixing chamber 75 by energizing electrical actuator 50 to move needle valve 59 to an open position. In the illustrated example of FIG. 3, two injections take place relatively early in the compression stroke allowing for ample time for a thorough mixing with air and fuel vapor to occur. Those skilled in the art will appreciate that any number of internal liquid fuel injections of differing quantities can be performed with the fuel injector 15 illustrated in FIG. 2. Those skilled in the art will appreciate that a variety of strategies that may or may not be coordinated with the flow of air into mixing chamber 75 could be performed in order to use different strategies for obtaining a relatively homogenous air/fuel mixture in mixing chamber 75. Those skilled in the art will appreciate that, although it would be desirable for the liquid fuel sprayed into mixing chamber 75 to be thoroughly vaporized and mixed with the air, in some instances, it might be desirable for some of the liquid fuel to remain in a liquid state when sprayed into mixing chamber 75. In the illustrated embodiment, air will be continuously flowing into mixing chamber 75 throughout the compression stroke. In an alternative embodiment in which check valve 77 are omitted, the flow of air into mixing chamber 75 could be controlled by selectively opening and closing nozzle valve 69 to allow air into mixing chamber. It might be possible through selective openings and relative timings of the opening of needle valve 59 and nozzle valve 69 during the compression stroke to produce a very thorough mixing strategy. In order to inhibit auto ignition of the air/fuel mixture in mixing chamber 75, the timing of the spraying of liquid fuel and the volume sizing of mixing chamber should be such that the air/fuel mixture is too rich to auto ignite within injector 15.

Figure 4:
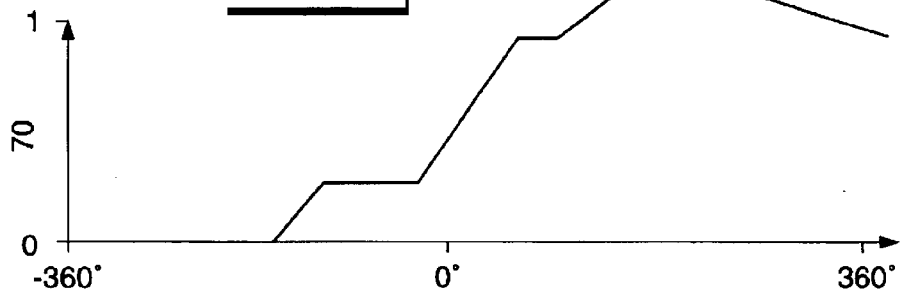
FIG. 4 is a graph of piston 70 (FIG. 2) position verses engine cylinder position for the example injection sequence.
Figure 5:
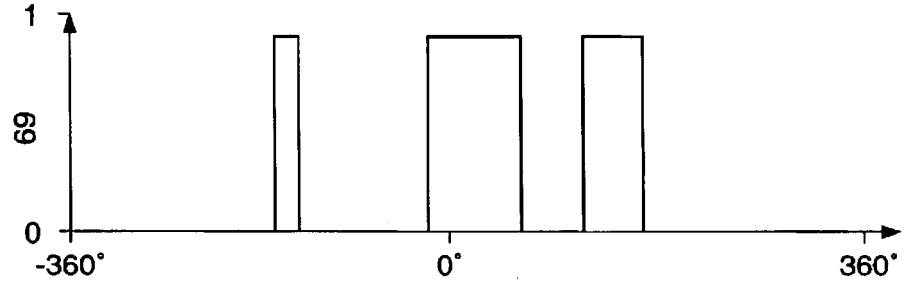
FIG. 5 is a graph of valve 69 (FIG. 2) position verses engine cylinder position for the example injection sequence.
Figure 6:
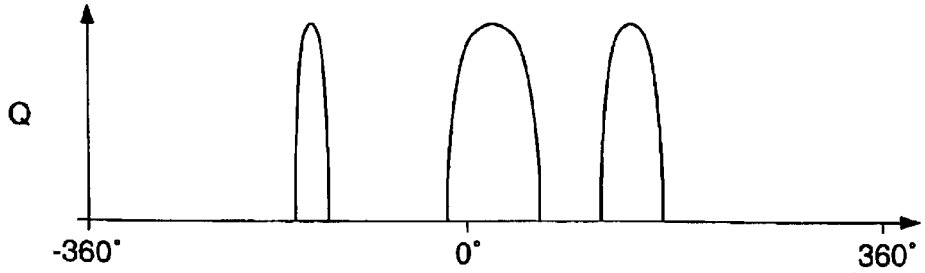
FIG. 6 is a graph of injection quantity verses engine cylinder position for the example injection sequence.

As the engine piston continues upward during the compression stroke, the air and fuel in mixing chamber 75 continue to mix. At some desired injection timing, both electrical actuators 51 and 52 are energized to open actuation control valve 27 and nozzle control valve 28 to the flow of high pressure actuation fluid. These two valves need not necessarily be energized simultaneously. In the illustrated example, electrical actuator 52 is energized shortly before piston top dead center in order to begin movement of piston 70 to compress the contents of mixing chamber 75. This is illustrated in FIG. 4 by the initial slopped portion of the curve in the region of TDC. At some desired injection timing thereafter, electrical actuator 51 is energized to open nozzle control valve 28 to cause nozzle valve 69 to move downward toward its open position to begin the injection of the air/fuel mixture into the engine cylinder. This is shown in FIG. 5 by nozzle valve 69 moving from a closed position to an open position shortly before piston top dead center. FIG. 6 shows that the actual injection event is contemporaneous with the opening and closing of nozzle valve 69. At the desired end of the first injection event, electrical actuator 51 is deenergized to allow nozzle valve 69 to move to its closed position. In the illustrated example, electrical actuator 52 remains energized and actuation control valve 27 remains open to maintain pressure on the top side of piston 70. Thus, when nozzle valve 69 closes, piston 70 continues moving downward until the pressure and spring forces reach an equilibrium causing the piston to stop movement. A short time later, a second injection event is initiated by again energizing needle control valve 28 to open nozzle valve 69. When this occurs, the piston 70 continues moving downward injecting the remaining portion of the fuel/air mixture in mixing chamber 65. In the preferred embodiment, the injection sequence is not finished until piston 70 reaches its fully advanced position covering air inlet passages 78. In the illustrated example, this is accomplished with two separate injection events. One that begins shortly before top dead center and a second that happens later in the expansion stroke. Sometime thereafter, actuators 51 and 52 are deenergized and piston 70 retracts under the action of its return spring. However, it might be desirable to maintain piston 70 in its downward advanced position throughout the engines power stroke to avoid drawing post combustion products into mixing chamber 75. On the other hand, in some instances it might be desirable to draw combustion products into mixing chamber 75 to produce some desired effect in a subsequent injection sequence.

In the illustrated embodiment, the mixing chamber 75 is located entirely within fuel injector 15. Nevertheless, those skilled in the art will appreciate that mixing chamber 75 could be located at least partially outside of injector body 19. In addition, the illustrated embodiment shows that air for mixing chamber 75 is preferably drawn from engine cylinder 17; however, those skilled in the art will appreciate that air can be drawn from any suitable source. Air from the engine cylinder is preferred because it is already being pressurized by movement of the engine piston. Those skilled in the art will appreciate that the present invention provides a means of creating a homogenous charge of fuel vapor and air, and a means by which ignition timing and to some extent burn duration can be controlled. Ignition is controlled electronically by opening nozzle valve 69 at some desired timing while applying a downward hydraulic force on piston 70. Upon leaving injector 15, the mixture should shortly thereafter auto-ignite in a manner similar to conventional diesel engine operation. The burn duration can be somewhat controlled by the rate at which the air/fuel mixture is introduced into the engine cylinder as well as the number of injection events that are desired to occur, and when the timing of those events is made to happen. In other words, with the illustrated fuel injection system, an at least partially homogeneously charged gas mixture can be delivered into the engine combustion chamber at various rates and timings to control engine cylinder pressure and auto ignition timing to produce relatively low undesirable emissions while possibly improving brake specific fuel consumption at the same time. Depending upon the circumstances, the liquid fuel is partially or totally vaporized before being injected into the engine cylinder. The fuel and air will be mixed prior to injection into the combustion chamber, unlike conventional diesel engine operation. The fuel (vapor and liquid) and air mixture could be injected into the combustion chamber at various rates to control the auto-ignition timing. The present invention also allows for a relatively low fuel system pressure, since the fuel is injected internally within the injector into a mixing chamber that is preferably at a substantially lower pressure than that normally encountered in conventional diesel engine operation when injection occurs when an engine piston is at or near top dead center. Since the fuel vapor/air mixture burns relatively fast after injection, the fuel could be burned after top dead center to optimize the work output and to improve brake specific fuel consumption.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A method of operating an engine, comprising the steps of:

mixing fuel vapor with air in a fuel injector comprising;

an injector body having an air/fuel mixing chamber and a liquid fuel chamber disposed therein;

a first valve at least partially positioned in said injector body and fluidly positioned between said liquid fuel chamber and said air/fuel mixing chamber; and a second valve at least partially positioned in said injector body and fluidly positioned between said air/fuel mixing chamber and an outside surface of said injector body;

injecting the mixture of fuel vapor and air into an engine cylinder; and igniting the mixture in the engine cylinder.

2. The method of claim 1 wherein said mixing step includes a step of moving air from the engine cylinder into the injector.

3. The method of claim 2 wherein said moving step is performed during a compression stroke of said engine cylinder.

4. The method of claim 1 wherein said mixing step includes a step of spraying liquid fuel into the mixing chamber within said injector.

5. The method of claim 4 wherein said mixing step includes moving air into said mixing chamber during said spraying step.

6. The method of claim 4 wherein said spraying step includes a step of opening the second valve within said injector.

7. The method of claim 1 including a step of avoiding ignition of the mixture in the mixing chamber.

8. The method of claim 7 wherein said avoiding step includes a step of lowering an air-fuel ratio in said mixing chamber below an auto-ignition level.

9. The method of claim 1 wherein said injecting step includes the steps of:

compressing said mixture; and opening said mixing chamber to the said engine cylinder.

10. The method of claim 9 wherein said compressing step includes a step of energizing a first electrical actuator; and said opening step includes a step of energizing a second electrical actuator.

11. The method of claim 9 including a step of applying a predetermined pressure to a movable piston with a pressurized actuation fluid.

12. The method of claim 11 including a step of electronically controlling said predetermined pressure.

13. The method of claim 11 wherein said actuation fluid is different from fuel fluid.

14. The method of claim 9 wherein said opening step includes a step of opening an annular passage between said mixing chamber and said engine cylinder.

15. The method of claim 1 wherein said injecting step is performed a plurality of times in one engine cycle.

16. The method of claim 15 wherein at least one of said plurality of times begins during a power stroke of said engine cylinder.

17. The method of claim 1 wherein said igniting step includes a step of compressing air in said engine cylinder above an auto-ignition level.

18. A fuel injector comprising:

an injector body having an air/fuel mixing chamber and a liquid fuel chamber disposed therein;

a first valve at least partially positioned in said injector body and fluidly positioned between said liquid fuel chamber and said air/fuel mixing chamber; and a second valve at least partially positioned in said injector body and fluidly positioned between said air/fuel mixing chamber and an outside surface of said injector body.

19. The fuel injector of claim 18 including a first electrical actuator operably coupled to said first valve; and a second electrical actuator operably coupled to said second valve.

20. The fuel injector of claim 19 including a first biaser operably positioned in said injector body to bias said first valve toward a closed position; and a second biaser operably positioned in said injector body to bias said second valve toward a closed position.

21. The fuel injector of claim 18 wherein said air/fuel mixing chamber is partially defined by a displacement surface of a movable piston.

22. The fuel injector of claim 21 wherein said movable piston includes a hydraulic surface exposed to fluid pressure in a hydraulic cavity disposed in said injector body.

23. The fuel injector of claim 22 including a third valve attached to said injector body and being movable between a first position in which said hydraulic cavity is fluidly connected to a high pressure passage, and a second position in which said hydraulic cavity is fluidly connected to a low pressure passage.

24. The fuel injector of claim 23 including an electrical actuator operably coupled to said third valve.

25. The fuel injector of claim 18 wherein said injector body includes a fuel inlet and an actuation fluid inlet.

26. The fuel injector of claim 18 wherein said second valve includes a valve member with an opening hydraulic surface exposed to fluid pressure in a control chamber; and a pressure control valve attached to said injector body and being movable between a first position that fluidly connects said control chamber to a high pressure passage, and a second position that fluidly connects said control chamber to a low pressure passage.

27. A fuel injection system comprising:

a source of liquid fuel;

a nozzle body including an air/fuel mixing chamber at least partially disposed therein, and including a first valve fluidly positioned between said air/fuel mixing chamber and an outside surface of said nozzle body; and a second valve movable between a first position in which said air/fuel mixing chamber is fluidly connected to said source of liquid fuel, and a second position in which said air/fuel mixing chamber is closed to said source of liquid fuel.

28. The fuel injection system of claim 27 wherein said fuel injector nozzle body is a portion of a fuel injector with said air/fuel mixing chamber disposed therein, and including a fuel inlet fluidly connected to said source of liquid fuel.

29. The fuel injection system of claim 28 including a source of actuation fluid that is different from said liquid fuel; and said fuel injector including an actuation fluid inlet fluidly connected to said source of actuation fluid.

30. The fuel injection system of claim 29 including a first electrical actuator operably coupled to said first valve; and a second electrical actuator operably coupled to said second valve.

31. The fuel injection system of claim 30 wherein said air/fuel mixing chamber is partially defined by a displacement surface of a movable piston.

32. The fuel injection system of claim 31 wherein said movable piston includes a hydraulic surface exposed to fluid pressure in a hydraulic cavity least partially disposed in said fuel injector.

33. The fuel injection system of claim 32 including a third valve movable between a first position in which said hydraulic cavity is fluidly connected to said actuation fluid inlet, and a second position in which said hydraulic cavity is fluidly closed to said actuation fluid inlet.

34. The fuel injector of claim 33 including an electrical actuator operably coupled to said third valve.

35. The fuel injection system of claim 34 wherein said first valve includes a valve member with an opening hydraulic surface exposed to fluid pressure in a control chamber; and a nozzle control valve movable between a first position that fluidly connects said control chamber to said actuation fluid inlet, and a second position that fluidly closes said control chamber to said actuation fluid inlet.

36. An engine comprising:

an engine housing having at least one cylinder;

a fuel injector comprising:

an injector body having an air/fuel mixing chamber and a liquid fuel chamber disposed therein;

a first valve at least partially positioned in said injector body and fluidly positioned between said liquid fuel chamber and said air/fuel mixing chamber; and a second valve at least partially positioned in said injector body and fluidly positioned between said air/fuel mixing chamber and an outside surface of said injector body;

the fuel injector being attached to said engine housing, and including a nozzle tip positioned in said cylinder.

37. The engine of claim 36 wherein said fuel injector includes an electrical actuator operably coupled to said first valve.

38. The engine of claim 36 wherein said fuel injector includes a movable piston with a displacement surface that defines a portion of said air/fuel mixing chamber.

39. The engine of claim 38 wherein said movable piston includes a hydraulic surface exposed to fluid pressure in a hydraulic cavity disposed in said fuel injector.

40. The engine of claim 29 including an actuation valve movable between a first position in which said hydraulic cavity is fluidly connected to said actuation fluid inlet, and a second position in which said hydraulic cavity is fluidly closed to said actuation fluid inlet.

41. The engine of claim 36 wherein said fuel injector includes a fuel inlet fluidly connected to a source of liquid fuel, and an actuation fluid inlet fluidly connected to a source of actuation fluid that is different from said liquid fuel.

* * * * *